US009695016B2

(12) United States Patent
Sonnenmoser et al.

(10) Patent No.: US 9,695,016 B2
(45) Date of Patent: Jul. 4, 2017

(54) FUNCTIONAL MONITORING OF A SAFETY ELEMENT

(75) Inventors: Astrid Sonnenmoser, Ebikon (CH); Martin Hess, Baar (CH); David Michel, Thalwil (CH)

(73) Assignee: Inventio AG, Hergiswil (CH)

( * ) Notice: Subject to any disclaimer, the term of this patent is extended or adjusted under 35 U.S.C. 154(b) by 815 days.

(21) Appl. No.: 13/569,273

(22) Filed: Aug. 8, 2012

(65) Prior Publication Data

US 2013/0041603 A1 Feb. 14, 2013

(30) Foreign Application Priority Data

Aug. 11, 2011 (EP) ..... 11177268

(51) Int. Cl.
*B66B 13/22* (2006.01)
*B66B 5/00* (2006.01)

(52) U.S. Cl.
CPC ..... *B66B 13/22* (2013.01); *B66B 5/0037* (2013.01)

(58) Field of Classification Search
CPC ..... G06F 19/00; B66B 13/22; B66B 5/0037; B66B 1/34; B66B 1/3415; B66B 1/343; B66B 1/3438; B66B 1/3446
USPC ..... 702/58; 340/521, 679; 244/194
See application file for complete search history.

(56) References Cited

U.S. PATENT DOCUMENTS 6,178,445 B1 1/2001 Dawkins et al.
6,267,219 B1 * 7/2001 Spannhake et al. ..... 198/323
2003/0111300 A1 6/2003 Schuster
2005/0284706 A1 * 12/2005 Vecchiotti ..... B66B 13/22 187/313
2006/0157305 A1 * 7/2006 DePlazes ..... B66B 5/0031 187/391
2006/0214066 A1 * 9/2006 Yount et al. ..... 244/221
2007/0090943 A1 * 4/2007 Tomek ..... 340/521
(Continued)

FOREIGN PATENT DOCUMENTS

EP 1427660 A1 6/2004
EP 1427662 A1 6/2004
(Continued)

OTHER PUBLICATIONS

"Lifts (elevators)—Design and Development of Programmable Electronic Systems in Safety-Related Applications for Lifts (PERSSRAL)," International Standard, First Edition, Jan. 15, 2009, pp. 1-52.

*Primary Examiner* — Mohamed Charioui
*Assistant Examiner* — Catherine Rastovski
(74) *Attorney, Agent, or Firm* — Shumaker Loop & Kendrick; William J. Clemens

(57) ABSTRACT

A method of checking the functional capability of at least one safety element of a safety circuit of an elevator installation utilizes a first processing unit and a second processing unit for the at least one safety element. The at least one safety element is connected with a control unit by a communications network. At least one signal is provided by the first processing unit on the basis of at least one communication from the control unit. The at least one provided signal is detected by the second processing unit connected with the first processing unit and is communicated to the control unit by way of the communications network. The at least one communicated signal is checked for the validity thereof by the control unit.

14 Claims, 2 Drawing Sheets

(56) References Cited

U.S. PATENT DOCUMENTS

| | | | | |
|---|---|---|---|---|
| 2009/0277724 | A1* | 11/2009 | Thumm et al. | 187/393 |
| 2011/0302466 | A1* | 12/2011 | Ikawa et al. | 714/704 |
| 2014/0190773 | A1* | 7/2014 | Sonnenmoser et al. | 187/247 |

FOREIGN PATENT DOCUMENTS

| | | | |
|---|---|---|---|
| EP | 1638880 | A1 | 3/2006 |
| WO | 03/024854 | A1 | 3/2003 |
| WO | 03/024856 | A1 | 3/2003 |
| WO | 2005/000727 | A1 | 1/2005 |
| WO | 2009/010410 | A1 | 1/2009 |
| WO | 2010/097404 | A1 | 9/2010 |
| WO | 2010/109748 | A1 | 9/2010 |
| WO | WO-2010/109748 | * | 9/2010 |

* cited by examiner 1 control unit
2 communications network
3 safety element
4 transmitting/ receiving unit
5 first processing unit
6 second processing unit
7 detection or interrogation unit
8 monitored unit
14 connection

FUNCTIONAL MONITORING OF A SAFETY ELEMENT

CROSS-REFERENCE TO RELATED APPLICATION

This application claims priority to European Patent Application No. 11177268.7, filed Aug. 11, 2011, which is incorporated herein by reference.

FIELD

The invention relates to a method of checking the functional capability of at least one safety element of a safety circuit of an elevator installation, wherein a first processing unit and second processing unit are used for the at least one safety element and the at least one safety element is connected with a control unit by way of a communications network.

BACKGROUND

Conventional elevator installations have safety circuits which consist of safety elements connected in series. These safety elements monitor, for example, the state of shaft doors or car doors. Such a safety element can be a door contact, a lock contact, a buffer contact, a flap contact, a sensor, an actuator, a travel switch, an emergency stop switch, etc. An open contact shows that, for example, a door is open and a potentially impermissible door state has arisen. If with the opened contact an impermissible open state of the door is now identified then the safety circuit is interrupted, which has the consequence that a drive or brake, which influences the travel of an elevator car, brings the elevator car to a stop.

A safety system or a safety circuit for an elevator installation is known from the document EP 1638880, which comprises a control unit as well as at least one safety element and a bus as communications network. The bus or safety bus enables communication between the at least one safety element and the control unit. The safety element can, for example, monitor the state of shaft and car doors. Moreover, the at least one safety element consists of a receiver and a transmitter.

The document EP 1427662 describes a safety system with safety bus. The safety bus is used in order to enable a secure and reliable monitoring of shaft doors of an elevator installation.

The document EP 1427660 describes a safety system with safety bus which permits evaluation of the state of car and shaft doors.

The understanding of bus or bus system is, for example, as described in the book 'Bussysteme, Parallele and serielle Bussysteme, lokale Netze', by Georg Färber, R. Oldenbourg Verlag Munich Vienna, 1987, ISBN 3-486-20120-4.

SUMMARY

A safety system or a safety circuit for elevator installations with the use of a bus system has to be constructed to be safe. Otherwise, for example, undefined states or faulty interpretations can occur. In particular, the interrogation of the safety elements of the safety system by way of the safety bus has to be absolutely secure and reliable.

For safety elements in safety-sensitive environments, high demands with respect to the fail-safety thereof are imposed so that harm to persons in an elevator installation can be prevented. Safety-sensitive environments exist wherever due to a functionally incapable safety element unacceptable risks for the health of persons can arise. The requirements for safety elements are specified in various safety standards such as, for example, in European Norm IEC 61508. European Norm IEC 61508 contains the minimum requirements so that the safety in systems and electrical installations can be increased. For that purpose this Norm defines four so-termed safety integrity stages SIL1 to SIL4 which are applicable as a measure for the operational safety of an installation or a system. The safety integrity stage SIL4 is in that case the highest operational safety stage.

An object of the invention is to propose a simple and efficient method for checking the functional capability of safety elements of a safety circuit of an elevator installation.

A core of the invention consists in that for checking the functional capability of a safety element of a safety circuit of an elevator installation a first processing unit of the safety element provides at least one signal on the basis of at least one communication from a control unit, that a second processing unit detects the provided at least one signal and communicates it to the control unit and that the communicated at least one signal is checked with respect to its validity by the control unit. For that purpose the first and second processing units are connected together.

The at least one safety element is connected with the control unit by way of a communications network. A hardwired or a non-hardwired communications network, such as, for example, a fixed network, a mobile communications network, a radio communications network, a bus system, etc., can be used as the communications network.

In an advantageous embodiment the first and second processing units of the at least one safety element are directly connected together. A direct connection in that case means that the first processing unit is connected by way of an output of the first processing unit with an input of the second processing unit and/or conversely. Microprocessors, for example, can be used as first and second processing units.

The first and second processing units can in that case have different command sets. By that is meant that the two processing units can have, inter alia, different functionalities, different tasks, etc. Thus, for example, a communication between the first processing unit and the second processing unit could be initiated only by the second processing unit. Moreover, provision can be made for only the first processing unit to be able to provide at least one signal, for example in that the first processing unit creates or generates this signal.

The second processing unit can have, by comparison with the first processing unit and conversely, a different priority for communication with the control unit. A ranking for communication with the control unit is established by the priority. This means, for example, that in the case of a simultaneous communications attempt by the first and second communications unit the control unit communicates with that processing unit which has the higher priority.

The at least one provided signal can be of any form. It can be either digital or analog. In that case, a bit train, a signal with a specific or defined frequency, a tone sequence, a pattern, a message, etc., can be used as the signal.

The at least one signal provided by the first processing unit can be present either in the at least one communication from the control unit or it can be set up or generated by the first processing unit.

The check of the functional capability of the at least one safety element of the safety circuit of the elevator installation can be performed in dependence on at least one rule. In that case, the at least one rule to be used can be as desired. Thus, for example, a frequency, a time instant, a clock time, etc., could, for example, be used as the at least one rule for the check. By frequency there is defined or indicated how often and at which intervals a check is to take place. Obviously, further rules could also be defined. Thus, for example, a further rule could read that after maintenance, after disturbance, etc., of the elevator installation a check is carried out.

An advantage of the invention is that it can be established in simple mode and manner whether the safety chain of the elevator installation or the at least one safety element of the safety circuit is functionally capable.

A further advantage of the invention is that the method according to the invention and the device according to the invention satisfy the operational safety requirement, which is specified in European Norm IEC 61508, at least in accordance with SIL3.A.

DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
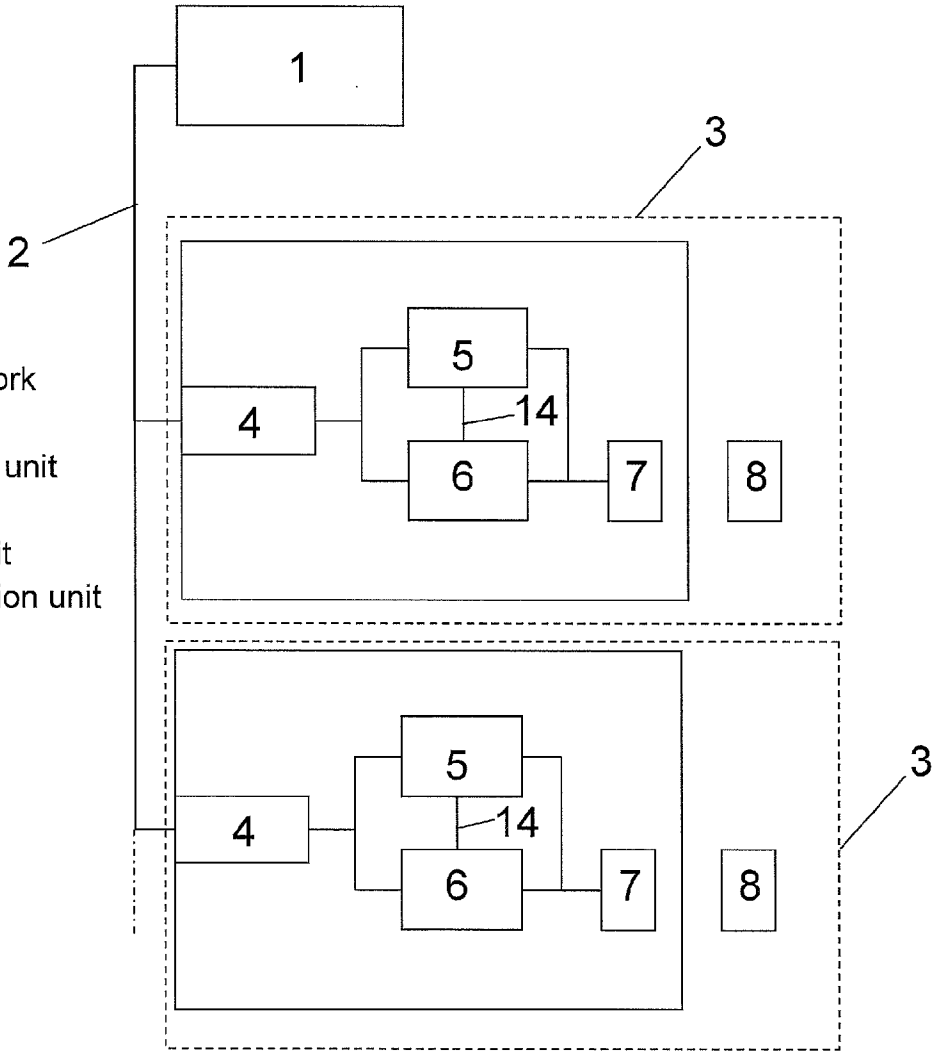
FIG. 1 is a simplified block diagram example of a safety element of a safety circuit.

FIG. 1 shows a simplified example for a safety element 3 of a safety circuit of an elevator installation. Components of an elevator installation are monitored by a safety element 3, thus, for example, the open or closed state of (shaft) elevator doors, the open or closed state of an elevator car door, the position of an elevator car, the cable tension of a support means of the elevator installation, the state of an elevator brake, etc. The safety elements 3 in that case are arranged at or in the vicinity of the components of the elevator installation and are connected with a control unit 1 by way of a communications network 2, wherein an elevator control unit of the elevator installation or a separate control unit can be used as the control unit 1.

A wire-bound or a non-wire-bound communications network can be used as the communications network 2. Thus, for example, a fixed network, a mobile communications network, a radio communications network, a bus system, etc., could be used.

The safety element 3 comprises at least one first processing unit 5 and second processing unit 6, a transmitting and receiving unit 4 for communication with the control unit 1 and a detection or interrogation unit 7. In this example, a contactless door monitoring unit is used as the safety element 3. A monitored unit 8, such as, for example, a RFID unit or radio frequency identification unit (RFID=radio-frequency identification), a magnet or similar is, for example, mounted on an elevator door, an elevator car door, a flap, etc. (not illustrated). The monitored unit 8 is disposed, when the elevator door is closed, in the range of the detection or interrogation unit 7, for example a radio-frequency transmitting/receiving unit, of the safety element 3.

If the elevator door is opened, the monitored unit 8 moves out of the range of the detection or interrogation unit 7. How the detection or interrogation unit 7 detects that, for example, a door is open is described in, for example, European Patent EP 1638880. The detection or interrogation unit 7 passes on at least one appropriate signal, for example a message, a digital signal, an analog signal, etc., to the second processing unit 6. The second processing unit 6 checks or processes the at least one signal and transmits at least one (alarm) signal, message, digital signal, analog signal, etc., to the control unit 1 by way of the transmitting and receiving unit 4. It is also conceivable for the second processing unit 6 to pass on the signal, which is obtained by the detection or interrogation unit 7, to the control unit 1 without checking or processing by way of the transmitting and receiving unit 4 and for the control unit 1 to undertake the checking or processing of the signal. The checking or processing serves to establish whether an unsafe state prevails, thus whether, for example, the elevator door is open, a sensor unit has detected safety-critical data, an overrun switch of the elevator car of the elevator installation was overrun, etc. How this checking or processing by the control unit 1 or by the second processing unit 6 is carried out depends on the obtained at least one signal. Thus, for example, it would be possible for, inter alia, a comparison with existing signals to be carried out, a difference to be calculated, etc.

However, in order that it is ensured that the safety element 3 is in a position of communicating to the control unit 1 a signal detected by the detection or interrogation unit 7 or to report an unsafe state as a consequence of a check or processing of the signal in the second processing unit 6 the functional capability of the safety element 3 has to be able to be checked or tested.

For that purpose at least one communication is sent from the control unit 1 to the first processing unit 5. The first processing unit 5 provides at least one signal on the basis of this at least one communication. The provided signal can in that case be as desired. Thus, use can be made of a digital signal, an analog signal, etc. A bit sequence, a pattern, a tone sequence, an image sequence, a signal with a frequency, etc., can, for example, be used as the signal. The communication can also be as desired. Thus, a digital signal, an analog signal, a signaling message of a communications network, a text message, etc., could, for example, be used as communication.

The first processing unit 5 can, for example, obtain from the control unit 1 the at least one communication with the requirement, as in this embodiment, to provide a signal with a specific frequency.

The at least one provided signal with the frequency from the first processing unit 5 can in that case either be set up or generated by the first processing unit 5 or be present in the at least one communication from the control unit 1.

The at least one provided signal is detected by the second processing unit 6 connected with the first processing unit 5. In that case, the first processing unit 5 and the second processing unit 6 can be directly connected together by the connection 14. The first processing unit 5 is connected by way of an output and/or input (not illustrated) via the connection 14 with an input and/or output (not illustrated) of the second processing unit 6. The connecting unit 14 can be hardwired or non-hardwired.

Detection of the at least one signal by the second processing unit 6 can, for example, be carried out in that the second processing unit 6 obtains transmission of the at least one signal from the first processing unit 5 automatically and/or without request or interrogates the first processing unit 5, i.e. the first processing unit 5 behaves passively. However, the detection can also be carried out in that the second processing unit 6 transmits a request communication to the first processing unit 5 and the first processing unit 5 thereupon communicates the at least one signal to the second processing unit 6.

The at least one signal detected by the second processing unit 6 is communicated to the control unit 1 by way of the communications network. The control unit 1 checks the at least one communicated signal with respect to the validity thereof, i.e. the control unit 1 compares the at least one communicated signal with the signal requested in the at least one communication to the first processing unit 5 or signal contained in this communication. If the signals do not correspond with one another, i.e. the at least one communicated signal is invalid, the control unit 1 could infer therefrom that the communication between the at least one safety element and the control unit 1 via the communications network is faulty and the safety chain is thus functionally incapable. In addition, the control unit 1 could infer therefrom that the safety element 3 is faulty or functionally incapable.

The afore-described functional check of the at least one safety element 3 can be carried out in dependence on at least one rule. The at least one rule can be as desired. Thus, for example, the frequency, time instant and/or clock time for the functional check can be regulated as the at least one rule. A rule could also read that after maintenance or conversion or modernization of the elevator installation a functional check is to be carried out.

A microprocessor, a circuit or similar can be respectively used, for example, as the first processing unit 5 and second processing unit 6. In that case, the two processing units 5, 6 can have different command sets. By that is meant that the first processing unit 5 by comparison with the second processing unit 6 and conversely has either less functions or different functions. Thus, for example, only the first processing unit 5 could have the function of creating the at least one signal. In addition, for example, the first processing unit 5 could have no function for communicating at least one signal to the control unit 1.

Moreover, the first processing unit 5 and the second processing unit 6 can have or be allocated different priorities for communication with the control unit 1. Thus, for example, a communication or signal from the second processing unit 6 could be preferentially handled by the control unit 1.

Figure 2:
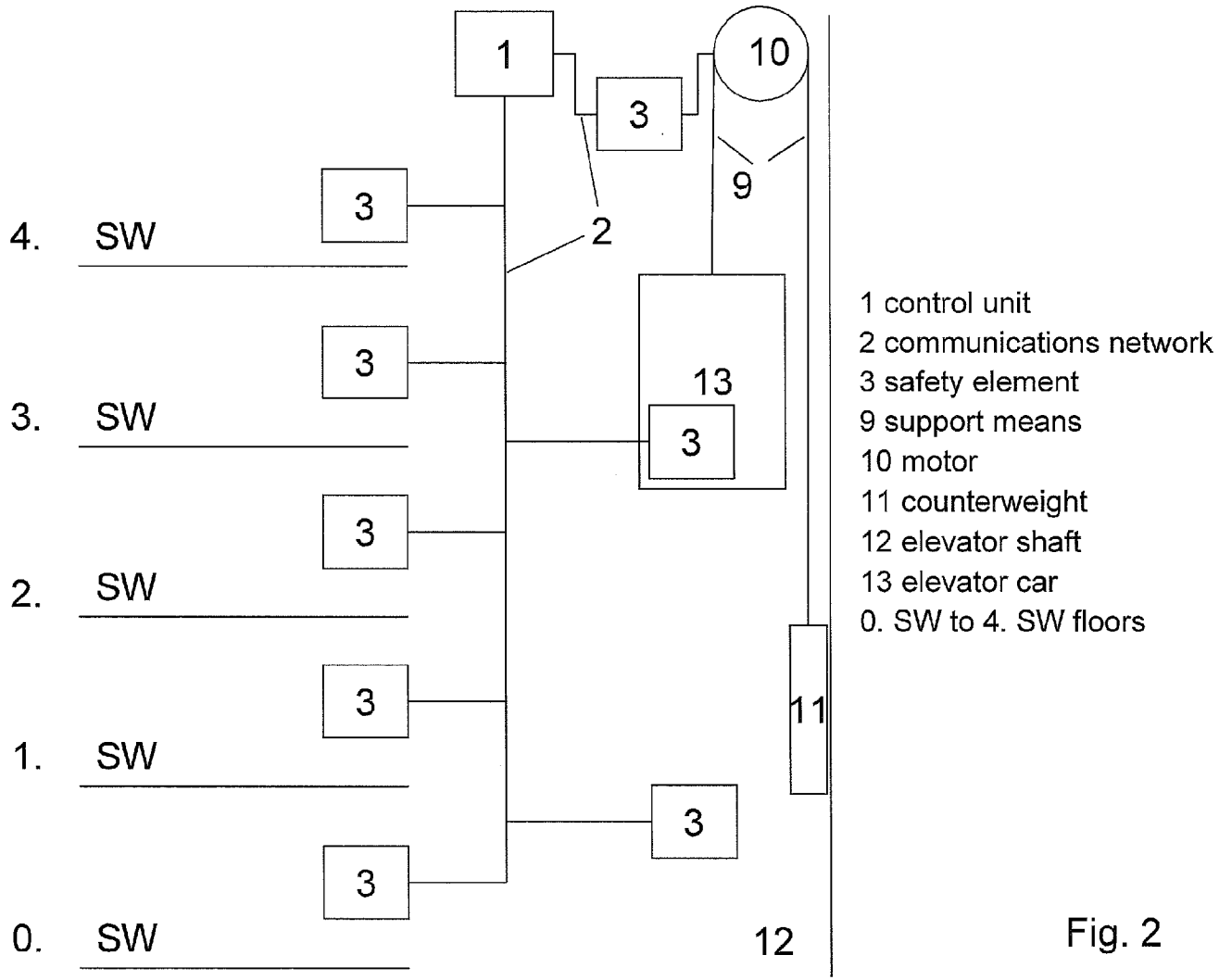
FIG. 2 is a schematic diagram of an elevator installation with a safety circuit and safety elements according to the invention present therein.

FIG. 2 shows an elevator installation with a safety circuit and safety elements 3 according to the invention, which are present therein, for performance of the method as is described in FIG. 1.

The method according to the invention can be used in any elevator installation such as, for example, a hydraulic elevator, a drive-pulley elevator, etc. In this example a drive-pulley elevator is illustrated. An elevator car 13 moves vertically by means of a motor 10 in an elevator shaft 12. In that case the elevator car 13 is suspended at a support means 9. A counterweight 11 moves in opposite sense to the elevator car 13 and is connected with the elevator car 13 by way of the support means 9, for example a cable, a wire cable with round cross-section, a belt with rectangular cross-section, a belt with round or oval cross-section, etc. The elevator car 13 travels to the individual floors 0. SW to 4. SW.

In addition, the elevator installation comprises at least one control unit 1. Safety elements 3 are connected by way of a communications network 2 with the control unit 1, which is termed safety circuit. In this example, a safety bus with a star-shaped network architecture is used as the communications network 2. A safety bus or a bus system with a serial network architecture is obviously also conceivable. The individual safety element 3 can in that case be arranged at the elevator doors (not illustrated) on the individual floors 0. SW to 4. SW, in the elevator car 13, at the motor 10 and in the shaft 12.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of checking a functional capability of a safety element of a safety circuit in an elevator installation, wherein the safety element is connected with a control unit by a communications network for monitoring a component of the elevator installation, comprising:

providing the safety element with a first processing unit and a second processing unit each connected to the communications network, the first and second processing units also being directly connected by a connection, wherein the second processing unit sends to the control unit a state signal representing a state of the component being monitored by the safety element;

generating a provided signal from the first processing unit in response to a communication received from the control unit;

transmitting the provided signal from the first processing unit directly to the second processing unit through the connection;

detecting the provided signal received through the connection with the second processing unit;

communicating the provided signal as a communicated signal from the second processing unit to the control unit by the communications network; and checking a validity of the communicated signal by the control unit, wherein the communicated signal is compared by the control unit with the communication, wherein the communicated signal is invalid and a functional incapability of the safety element is present if the communicated signal and the communication do not correspond with one another, and wherein the control unit controls the elevator installation in response to a result of the validity checking by bringing an elevator car of the elevator installation to a stop in response to the communicated signal being invalid and the functional incapability of the safety element being present.

2. The method according to claim 1 including performing the checking step in dependence on at least one rule.

3. The method according to claim 2 including using at least one of a frequency, a time instant and a clock time as the at least one rule.

4. The method according to claim 1 including generating the provided signal as a digital signal or an analog signal.

5. The method according to claim 1 including generating the provided signal with at least one of a bit sequence, a message, a frequency, a tone sequence and a pattern.

6. The method according to claim 1 including utilizing different command sets for operating the first processing unit and the second processing unit.

7. The method according to claim 1 including assigning different priorities for communication with the control unit to the first processing unit and the second processing unit.

8. The method according to claim 1 wherein the provided signal either is present in the communication from the control unit or is generated by the first processing unit.

9. The method according to claim 1 wherein the communications network is one of a hardwired communications network and a non-hardwired communications network.

10. A device for checking a functional capability of a safety element of a safety circuit in an elevator installation, wherein the safety element monitors a component of the elevator installation, comprising:

a control unit for controlling the elevator installation;

a first processing unit included in the safety element;

a second processing unit included in the safety element and being directly connected with the first processing unit by a connection;

a detection or interrogation unit included in the safety element and being connected to the second processing unit, the detection or interrogation unit generating a detection signal to the second processing unit in response to a state of the monitored component of the elevator installation; and a communications network connecting the safety element with the control unit, wherein the second processing unit responds to the detection signal by passing a state signal to the control unit representing a state of the monitored component, wherein the first processing unit generates a provided signal in response to a communication from the control unit over the communications network, the second processing unit detects the provided signal and communicates the detected provided signal to the control unit over the communications network as a communicated signal, wherein the provided signal is directly transmitted from the first processing unit to the second processing unit through the connection, and the control unit checks the communicated signal with respect to a validity thereof by comparison with the communication, and wherein the communicated signal is invalid and a functional incapability is present if the communicated signal and the communication do not correspond with one another, the control unit controlling the elevator installation in response to a result of the validity check by bringing an elevator car of the elevator installation to a stop in response to the communicated signal being invalid and the functional incapability of the safety element being present.

11. The device according to claim 10 wherein the detection or interrogation unit is a radio-frequency transmitting/receiving unit.

12. The device according to claim 10 wherein the monitored component is an elevator door and the detection or interrogation unit responds to open and closed states of the elevator door.

13. A device for checking a functional capability of a safety element of a safety circuit in an elevator installation, wherein the safety element monitors a component of the elevator installation, comprising:

a control unit for controlling the elevator installation;

a first processing unit included in the safety element;

a second processing unit included in the safety element and being directly connected with the first processing unit by a connection; and a communications network connecting the safety element with the control unit, wherein the first processing unit generates a provided signal in response to a communication from the control unit over the communications network, the second processing unit detects the provided signal and communicates the detected provided signal to the control unit over the communications network as a communicated signal, wherein the provided signal is directly transmitted from the first processing unit to the second processing unit through the connection, and the control unit checks the communicated signal, with respect to a validity thereof by comparison with the communication, and wherein the communicated signal is invalid and a functional incapability of the safety element is present if the communicated signal and the communication do not correspond with one another, the control unit controlling the elevator installation in response to a result of the validity check by bringing an elevator car of the elevator installation to a stop in response to the communicated signal being invalid and the functional incapability of the safety element being present.

14. The device according to claim 13 wherein the connection between the first processing unit and the second processing unit is one of hardwired and non-hardwired.

* * * * *